US005248324A

United States Patent [19]

Hara

[11] Patent Number: 5,248,324

[45] Date of Patent: Sep. 28, 1993

[54] ELECTROSTATIC PRECIPITATOR

[75] Inventor: Keiichi Hara, Tokyo, Japan

[73] Assignee: Filtration Japan Co., Ltd., Yanagata, Japan

[21] Appl. No.: 835,867

[22] Filed: Feb. 18, 1992

[30] Foreign Application Priority Data

Aug. 2, 1991 [JP] Japan ..... 3-216347

[51] Int. Cl.[5] ..... B03C 3/76

[52] U.S. Cl. ..... 96/37; 96/84; 96/97

[58] Field of Search ..... 55/141, 148, 145, 156, 55/154, 112, 139, 152

[56] References Cited

U.S. PATENT DOCUMENTS

| | | | |
|---|---|---|---|
| 1,882,949 | 10/1932 | Ruder | 55/156 X |
| 1,912,053 | 5/1933 | Wintermute | 55/156 X |
| 2,063,391 | 12/1936 | Malick | 55/148 X |
| 3,086,341 | 4/1963 | Brandt | 55/156 X |
| 3,729,815 | 5/1973 | Quintilian et al. | 55/156 X |
| 4,026,684 | 5/1977 | Finger | 55/148 X |
| 4,526,591 | 7/1985 | Getzin | 55/156 X |

FOREIGN PATENT DOCUMENTS

| | | | |
|---|---|---|---|
| 544384 | 2/1932 | Fed. Rep. of Germany | 55/148 |
| 63-171654 | 7/1988 | Japan . | |
| 63-171655 | 7/1988 | Japan . | |

*Primary Examiner*—Richard L. Chiesa
*Attorney, Agent, or Firm*—Oliff & Berridge

[57] ABSTRACT

An electrostatic precipitator of the present invention is composed of a discharge section positioned in a casing inducing gas to be treated containing unwanted matters such as dust and miscellaneous bacteria from a gas feeding duct to a gas exhaust duct and arranged in a state of crossing with a passage of the gas to be treated, and dust collecting sections each having a gas permeable configuration installed in parallel with each other at a distance in front and in the rear with respect to the discharge section, wherein a high voltage application unit is provided in the discharge section, a dust collecting chamber is provided at the lower part of the dust collecting sections, the discharge section, the dust collecting sections, the high voltage application unit and the dust collecting chamber are provided in one frame as one body, and the electrostatic precipitator is arranged to be installed freely in a row through a mounting flange provided on the peripheral surface of the frame with respect to a passage of the gas to be treated.

2 Claims, 5 Drawing Sheets

ELECTROSTATIC PRECIPITATOR

BACKGROUND OF THE INVENTION

1. Field of the Invention

The present invention relates to an electrostatic precipitator which makes it easy to improve the dust collecting efficiency.

2. Description of Prior Art

An electrostatic precipitator generates corona discharge between both electrodes of a discharge electrode and a dust collecting electrode by applying a high voltage between the discharge electrode and the dust collecting electrode producing a non-uniform electric field in the air so as to ionize the air in a portion where the electric field is intense, thereby to generate a charged zone. The principle of electrostatic precipitation is such that particles of dust and miscellaneous bacteria contained in gas to be treated are charged by flowing the gas to be treated through the charged zone produced between both electrodes of the discharge electrode and the dust collecting electrode, so that these charged particles are made to stick to the dust collecting electrode at an opposite potential so as to be collected.

FIG. 7 is a plan view of a principal part showing an embodiment of an electrostatic precipitator which has been heretofore used in general. In FIG. 7, the dust collecting section is composed of plate-shaped dust collecting electrodes 30*a* and 30*b* provided in parallel with each other along a passage of gas to be treated. In the discharge section, a discharge electrode 34 is constructed with a plate 31 extending in an intermediate portion between dust collecting electrodes 30*a* and 30*b* and needle pieces 33*a* and 33*b* fixed on a gas inflow side and gas outflow side, respectively, of the plate 31 by means of clasps 32*a* and 32*b*. The needle pieces 33*a* are embedded at a predetermined pitch along an end portion on the gas inflow side of the plate 31, and the pointed ends thereof extend toward the gas inflow side. Further, the needle pieces 33*b* are embedded at a predetermined pitch along an end portion on the gas outflow side of the plate 31, and the end portions thereof extend toward the gas outflow side.

In an electrostatic precipitator thus constructed, when a high voltage at which a discharge electrode 34 becomes a negative electrode is applied between the dust collecting electrodes 30*a* and 30*b* and the discharge electrode 34, corona discharges as shown with dotted lines are generated from the pointed ends of the needle pieces 33*a* and 33*b* toward the dust collecting electrodes 30*a* and 30*b*. As against the above, when gas to be treated containing dust flows as shown with an arrow mark, the greater part of the dust passing through a corona discharge area is charged negative.

Thus, a charged zone is formed in the portion where corona discharge is generated, and the dust charged in this charged zone is absorbed by the dust collecting electrodes 30*a* and 30*b* by means of the high electric field produced between the dust collecting electrodes 30*a* and 30*b* and the discharge electrode 34, and collected on the surfaces of these dust collecting electrodes 30*a* and 30*b*.

FIG. 8 shows an electrostatic precipitator which has been invented by the inventor of the present invention and put on the market. This electrostatic precipitator is composed of a discharge section 38 in which a discharge rod 36 where needle pieces 35 are embedded and hollow metallic rods 37 are installed collectively and a dust collecting section 40 in which hollow metallic rods 39 are installed collectively along the discharge section 38. Thus, in the electrostatic precipitator thus constructed, intense corona discharge is generated from the pointed ends of respective needle pieces 35 toward the dust collecting section 40. Further, due to the fact that the dust collecting section 40 is composed of an aggregate of hollow metallic rods 39, the surface area is increased on the whole and the dust collecting efficiency is improved.

Further, it is strongly demanded in recent years to remove bacteria while fitting an electrostatic precipitator to an air conditioner. In this case, it is desired to collect almost all the dust and miscellaneous bacteria contained in the gas to be treated which passes through the electrostatic precipitator.

However, when the dust and miscellaneous bacteria contained in the gas to be treated are in large quantities and the load is heavy, the demanded quantity cannot be satisfied in point of the dust collecting efficiency by the construction in the first conventional example (shown in FIG. 7) in which the dust collecting electrode and the discharge electrode are provided in parallel with each other with respect to the passage of the gas to be treated. For the purpose of improving the dust collecting efficiency, it is also possible to install the electrostatic precipitator having the structure shown in FIG. 6 while connecting it in a row to the passage of the gas to be treated. In this case, however, the distance from an inlet port to an exhaust port of the gas to be treated becomes lengthy, and the electrostatic precipitator becomes large in size, thus making it difficult to install it. The same is applied to the second conventional example (shown in FIG. 8).

Further, in a construction in which a dust collecting electrode and a discharge electrode are provided in parallel with each other with respect to a passage of the gas to be treated as in the past, reversely charged particles generated in a trace quantity with respect to the generating quantity of charged particles generated when the gas to be treated passes through the charged zone stick to the discharge electrode. As a result, the pointed end portion of the discharge electrode is thickened so as to hinder corona discharge, thus lowering the dust collecting efficiency. Thus, a hammering device giving an impact to the discharge electrode is required for removing reversely charged particles which have stuck to the discharge electrode. However, complete insulation is required for the hammering device since a high voltage is applied to the discharge electrode side, and installation of the hammering device is attended with complexity.

Further, a conventional electrostatic precipitator is provided with a hammering device for giving an impact to the dust collecting electrode and the discharge electrode in the passage of the gas to be treated in order to remove charged particles which have stuck to the dust collecting electrode and reversely charged particles which have stuck to the discharge electrode, but, in this case, the dust contained in the gas to be treated causes deterioration of the hammering device, which produces a difficult point in the maintenance aspect.

SUMMARY OF THE INVENTION

Accordingly, it is an object of the present invention to provide an electrostatic precipitator composed of a discharge section loaded in a casing inducing gas to be treated containing unwanted matters such as dust and miscellaneous bacteria from a gas feeding duct to a gas exhaust duct and arranged in a state of crossing with the passage of the gas to be treated, and dust collecting sections each having a gas permeable configuration which are installed in parallel with each other at a distance in front and in the rear of the discharge section, in which a high voltage application unit is provided in the discharge section, a dust collecting chamber is provided at the lower part of the dust collecting sections, the discharge section, the dust collecting sections, the high voltage application unit and the dust collecting chamber are provided in one frame as one body, and the electrostatic precipitator is arranged to be fitted freely in a row through a mounting flange provided on a peripheral surface of the frame with respect to a passage of the gas to be treated.

It is another object to the present invention to provide an electrostatic precipitator in which a hammer of a hammering device for removing unwanted matters which have stuck to dust collecting sections each having a gas permeable configuration and an outer end of a hammering rod hammered by the hammer are extended outside a casing.

Other objects, features and advantages of the present invention will be apparent from the detailed description which follows.

BRIEF DESCRIPTION OF THE DRAWINGS

The invention will be described in greater detail in the following detailed description with reference to the drawings, in which.

DETAILED DESCRIPTION OF THE PREFERRED EMBODIMENTS

An embodiment of the present invention will be described with reference to FIG. 1 to FIG. 6. Besides, the same symbols are to represent the same parts or corresponding parts in FIG. 1 to FIG. 6.

Figure 1:
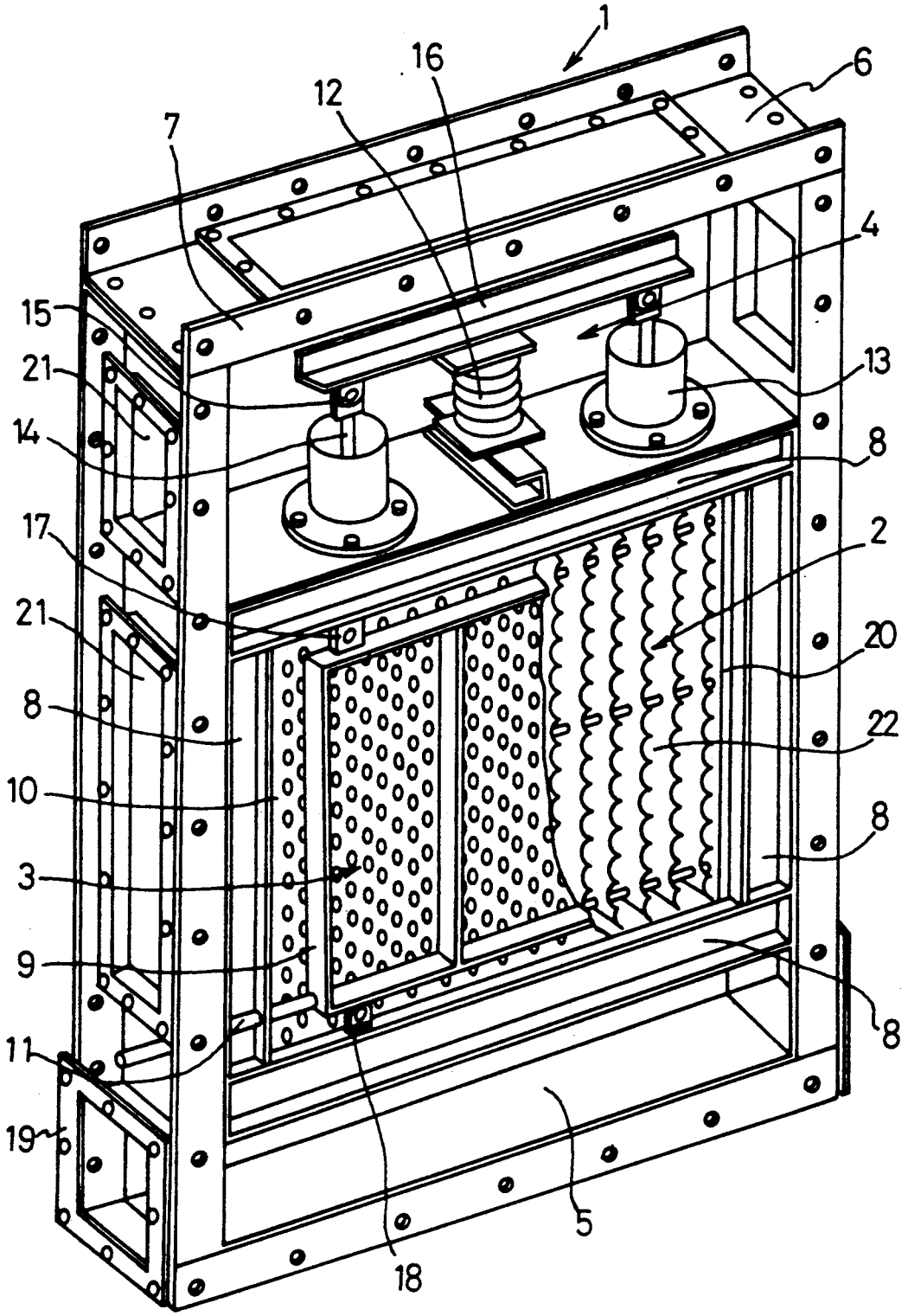
FIG. 1 is a perspective view showing a structure of an electrostatic precipitator according to the present invention.
Figure 2:
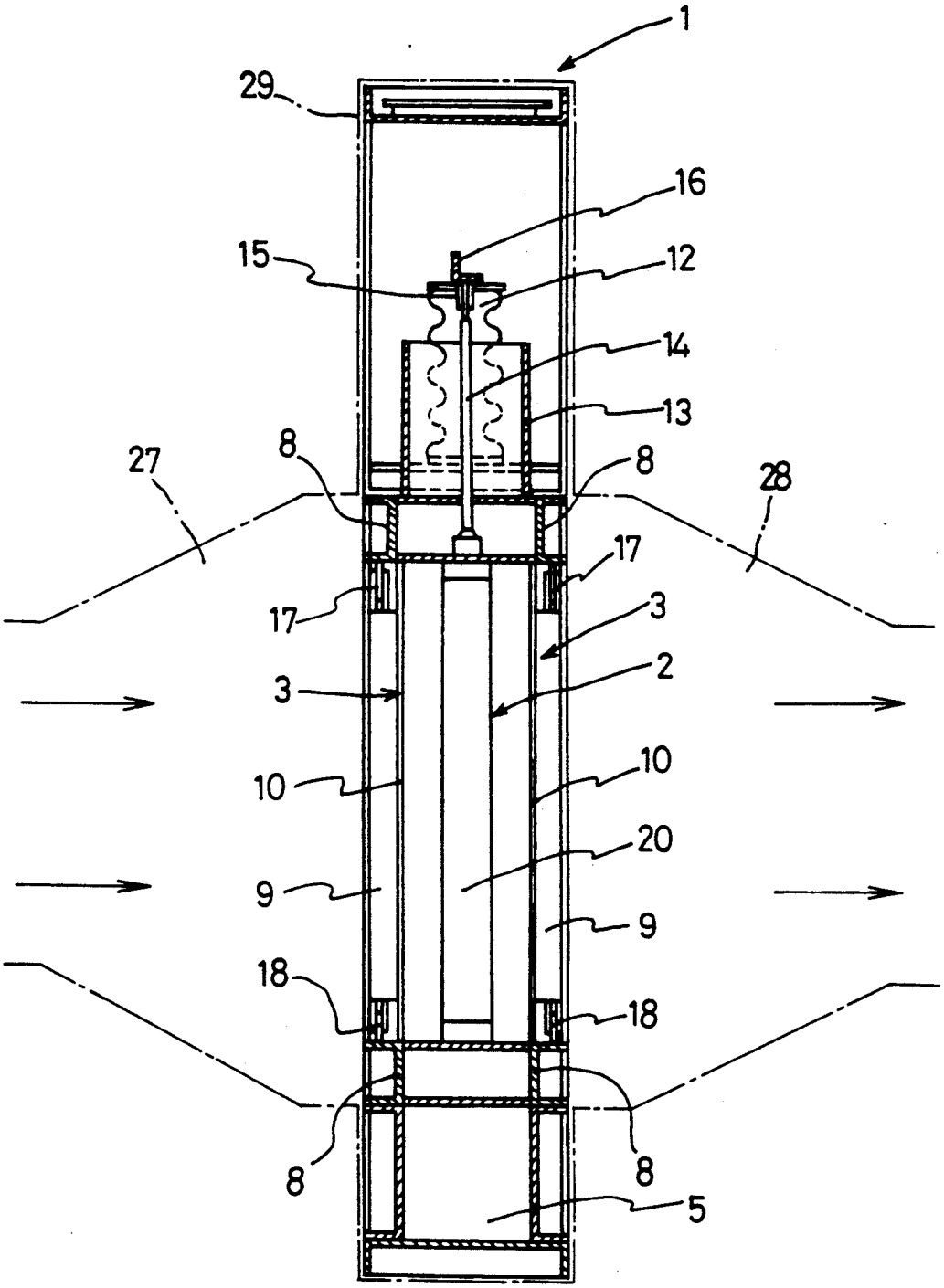
FIG. 2 is a side sectional view of an electrostatic precipitator according to the present invention.

As shown in the general perspective view in FIG. 1 and the side sectional view in FIG. 2, an electrostatic precipitator 1 of the present invention is composed practically of a discharge section 2 fixed at a position meeting at right angles with a passage of gas to be treated, dust collecting sections 3 installed in parallel with the discharge section 2 at distances in front and in the rear of the discharge section 2, a high voltage application unit 4 provided in the discharge section 2, and a dust collecting chamber 5 installed at a lower part of the dust collecting sections 3, and the discharge section 2, the dust collecting sections 3, the high voltage application unit 4 and the dust collecting chamber 5 are assembled in one body by means of a frame 6.

Further, since a gas inlet duct 27 and an opening portion of a gas exhaust duct 28 are joined to a sealing beam 8 surrounding the outer periphery of the dust collecting sections 3 in a four-cornered shape, all the gas to be treated passes through the dust collecting sections 3 and the discharge section 2. Thus, it has been made possible to solve short-pass of the dust which has been a problem in a conventional electrostatic precipitator.

The discharge section 2 is fitted at the central part of the electrostatic precipitator 1 through a supporting rod 14 suspended from a suspension fitting 15 fixed to a supporting cleat 16 as shown in FIG. 2. In the dust collecting section 3, a dust collecting electrode 10 is attached fixedly to a supporting frame 9 suspended by a suspension fitting 17 fixed to the sealing beam 8, the lower part of the dust collecting section 3 is fixed by a positioning fitting 18 of the supporting frame 9, and the dust collecting sections 3 are fitted in parallel with each other with respect to the discharge section 2 at distances in front and in the rear of the discharge section 2. Further, the distance between the pointed end of a discharge electrode of the discharge section 2 and the dust collecting electrode 10 is made variable depending on a load of the gas to be treated, thus leaving a gap at approximately 10 millimeters to 200 millimeters.

Figure 3:
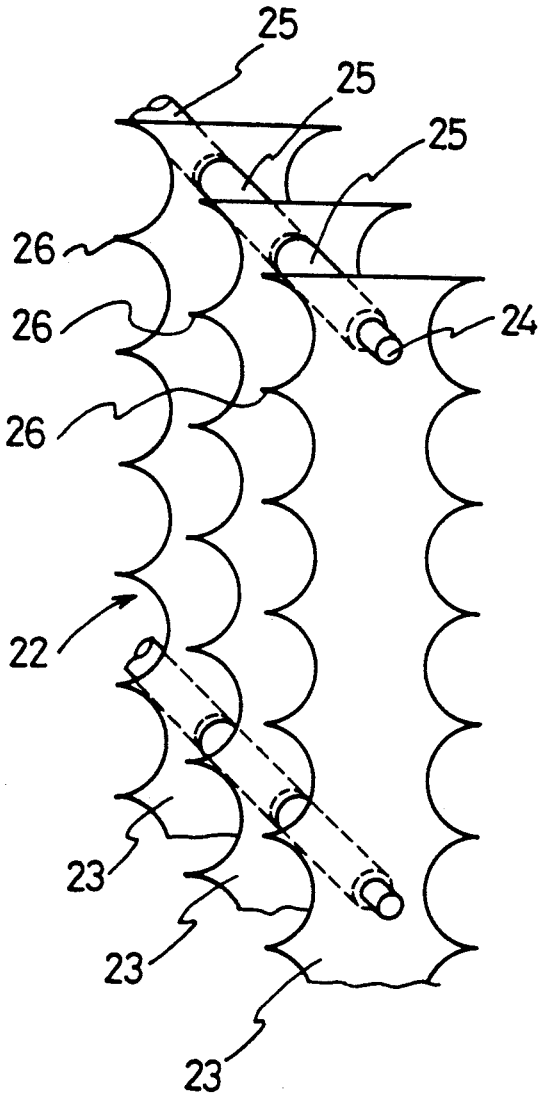
FIG. 3 is a perspective view of the discharge unit shown in FIG. 1.

Now, the discharge section 2 has a discharge electrode frame member 20 in a four-cornered shape, and a saw-toothed discharge electrode unit 22 is installed at a central opening portion of the discharge electrode frame member 20. Here, as shown in FIG. 3, the saw-toothed discharge electrode unit 22 is formed into saw-toothed discharge plates 23 by punching both side portions of belt metallic plates and installing a plurality of saw-toothed sections 26 in parallel with one another. A strut 24 is pierced through the saw-toothed discharge plates 23 thus constructed, and the saw-toothed discharge plates 23 are formed as one body in a state that these plates are separated from one another at predetermined spaces by spacers 25, thereby to form the discharge unit 22. Further, by inserting both ends of the strut 24 into a hole provided on the discharge electrode frame member 20, the discharge electrode frame member 20 and the discharge unit 22 are formed in one body thereby to contruct the discharge section 2.

In the discharge section 2 thus constructed, due to the fact that the saw-toothed sections 26 are arranged closely over the whole surface of the discharge section 2, corona discharge is generated innumerably from the pointed ends of the saw-toothed sections 26 and an intense electric field is uniformalized, thus constituting a very efficient discharge section.

Figure 4:
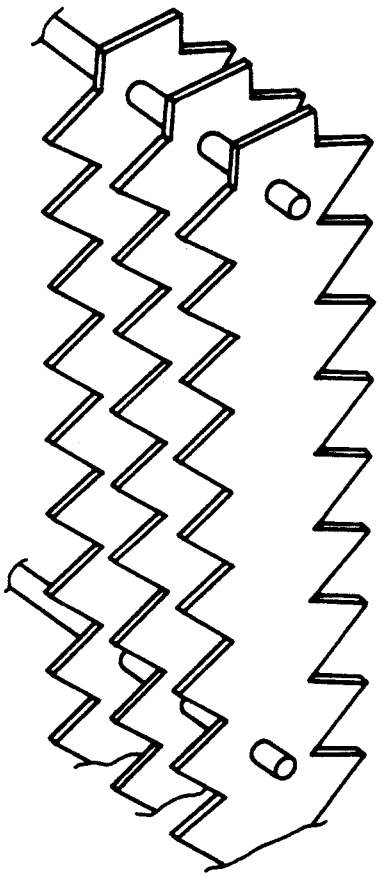
FIG. 4 is a perspective view showing another embodiment of the discharge unit.

Here, the configuration of the discharge electrode is not limited to that of the saw-toothed section 26 shown in FIG. 3, but may be saw-toothed configuration shown in FIG. 4. Moreover, although not shown, a wire may be used for the discharge electrode.

Next, the dust collecting section 3 is composed of the dust collecting electrode 10 a perforated plate having a high opening ratio and the supporting frame 9 fixedly attached to the dust collecting electrode 10 as shown in FIG. 1. Here, the configuration of the dust collecting electrode is shown as a perforated plate in FIG. 1, but a gas permeable configuration such as wire gauze, grating and expansion is also acceptable.

When a high voltage at which the discharge section becomes negative is applied between the discharge section 2 and the dust collecting sections 3 thus constructed, innumerable corona discharge is generated between the pointed ends of the respective saw-toothed sections 26 of the saw-toothed discharge plates 23 in the discharge section 2 and the dust collecting electrode 10 of the dust collecting section 3, and this portion becomes a very intense charged portion. Here, when gas to be treated containing unwanted matters such as dust and miscellaneous bacteria is fed to the gas inlet duct 27 as shown with an arrow mark shown in FIG. 2, this gas to be treated passes through the opening portion of the dust collecting electrode 10 of the dust collecting section 3 toward the discharge section 2. At this time, due to the fact that corona discharge is generated closely from the pointed ends of respective saw-toothed sections 26 of the saw-toothed discharge plates 23 in the discharge section 2 toward the dust collecting electrode 10 of the dust collecting section 3, dust and miscellaneous bacteria contained in the gas to be treated are charged negative between the dust collecting section 3 and the discharge section 2. The dust and miscellaneous bacteria thus charged are subjected to repulsion with respect to the negative discharge section 2 and subjected to attraction with respect to the dust collecting section 3 which is grounded to form a positive electrode.

The foregoing is the description when the discharge section 2 acts as a negative electrode, but a similar phenomenon is also presented when the discharge section 2 is made to be a positive electrode and the dust collecting section 3 is made to be a negative electrode and dust and miscellaneous bacteria contained in the gas to be treated are charged positive.

As a result, when the dust and miscellaneous bacteria contained in the gas to be treated are charged while they pass through the dust collecting section 3 toward the discharge section 2, they stick to the dust collecting electrode 10 and grow to dust particles, and become a dust lump as sticking particles grow by means of the operation of electric charges which are charged. The dust and miscellaneous bacteria which have grown to a dust lump is checked in terms of kinetic energy for moving by the flow of the gas to be treated by the dead weight thereof, and do not flow out from the outlet side of the gas to be treated.

A tube 13 surrounding a supporting rod 14 of the high voltage application unit 4 is provided for preventing the gas to be treated from flowing out along the supporting rod 14 by the atmospheric pressure in the tube 13. Reference numeral 12 which is provided at a cetral part of the supporting cleat 16 represents an insulator for insulating the supporting cleat 16 applied with a high voltage from a grounded cabinet. Reference numeral 21 represents an access door for maintenance and control purpose.

A hammering rod 11 is used for cleaning dust lumps which have stuck to the dust collecting section 3 and fitted to the supporting frame 9 at a gap, and the end portion of the hammering rod 11 is provided so as to project outside the casing. An impact is given to the supporting frame 9 by hammering the end portion of the hammering rod 11 at constant time intervals by means of a hammering device 49 shown in FIG. 5, so that dust lumps which have stuck to the dust collecting electrode 10 are removed.

The dust lumps which have received an impact by the hammering device 49 and deserted from the dust collecting section 3 drop due to the dead weight thereof and are collected in the dust collecting chamber 5. The dust lumps accumulated up to a certain point in the dust collecting chamber 5 are discharged by pulling a dust output port 19 and taking it out of the casing. In this case, the dust lumps are discharged by an artificial operation, but it is also possible to automate discharging of dust lumps by providing a screw conveyor and the like in the dust collecting chamber 5.

Figure 5:
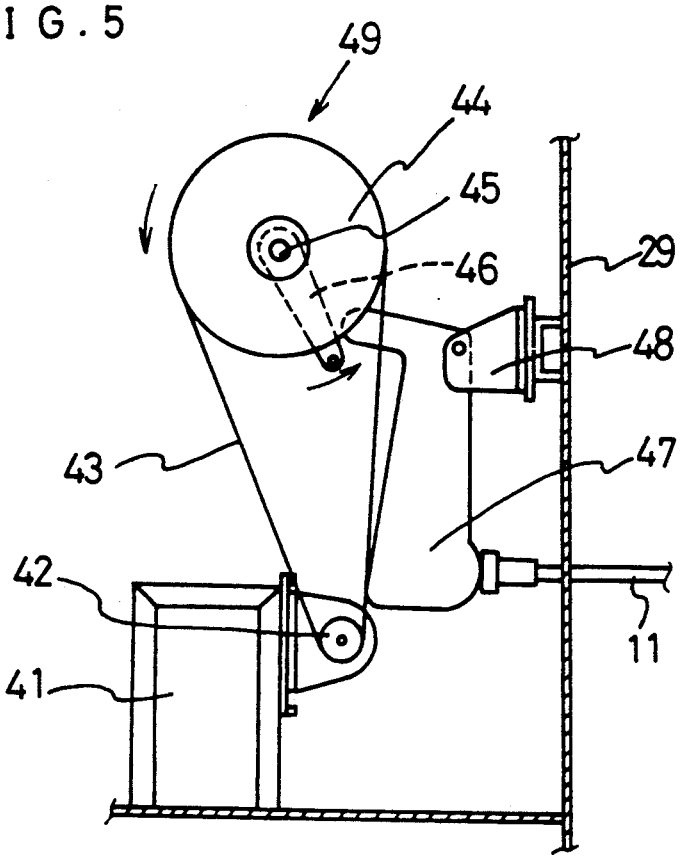
FIG. 5 is an explanatory view showing a hammering device.

FIG. 5 is an explanatory view of the hammering device 49. Reference numeral 41 represents a driving motor for the hammering device provided outside the casing 29, and rotates a driving pulley 42. The rotation of the driving pulley 42 is transmitted to a pulley 44 engaged through a belt 43. A cam shaft 45 is fixedly attached at the center of the pulley 44, and a cam 46 is coupled with the cam shaft 45 and the cam 46 rotates synchronously with the rotation of the pulley 44. When the cam 46 rotates periodically, an upper part of a hammer 47 supported by a hammer support fitting 48 fixed to the casing 29 and the cam 46 abut against each other thereby to oscillate the hammer 47, thus hammering the outer end portion of the hammering rod 11 at fixed time intervals and giving an impact to the dust collecting section 3.

Figure 6:
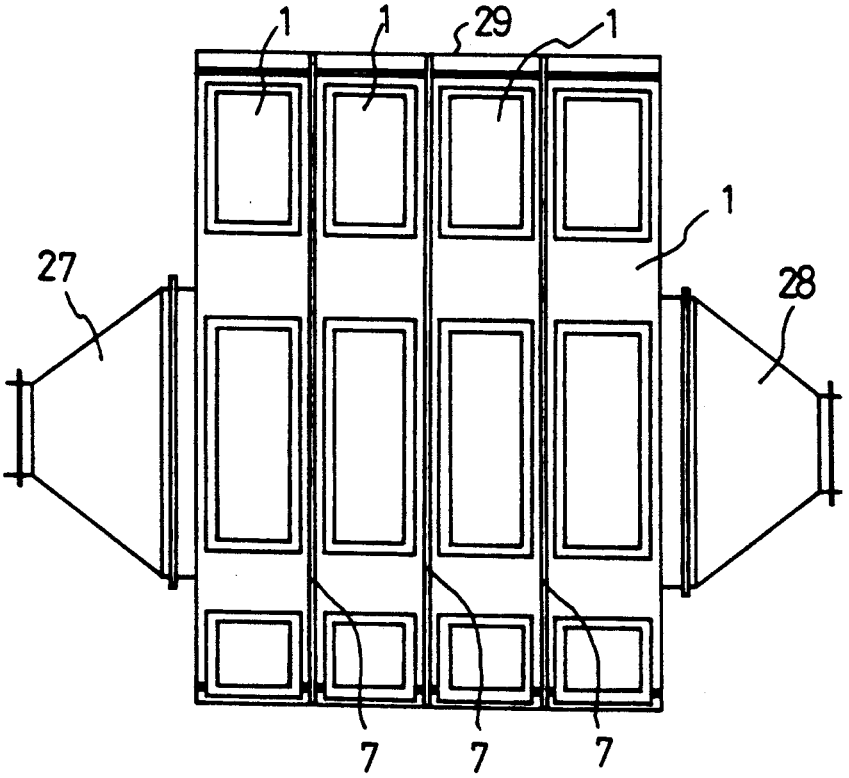
FIG. 6 is an explanatory view in case an electrostatic precipitator of the present invention is connected in a row.
Figure 7:
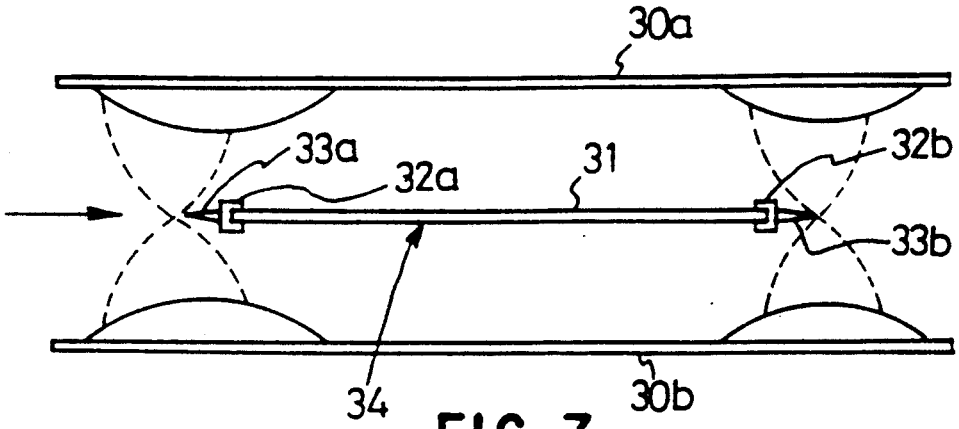
FIG. 7 PRIOR ART
FIG. 7 is a plan view showing a conventional electrostatic precipitator.
Figure 8:
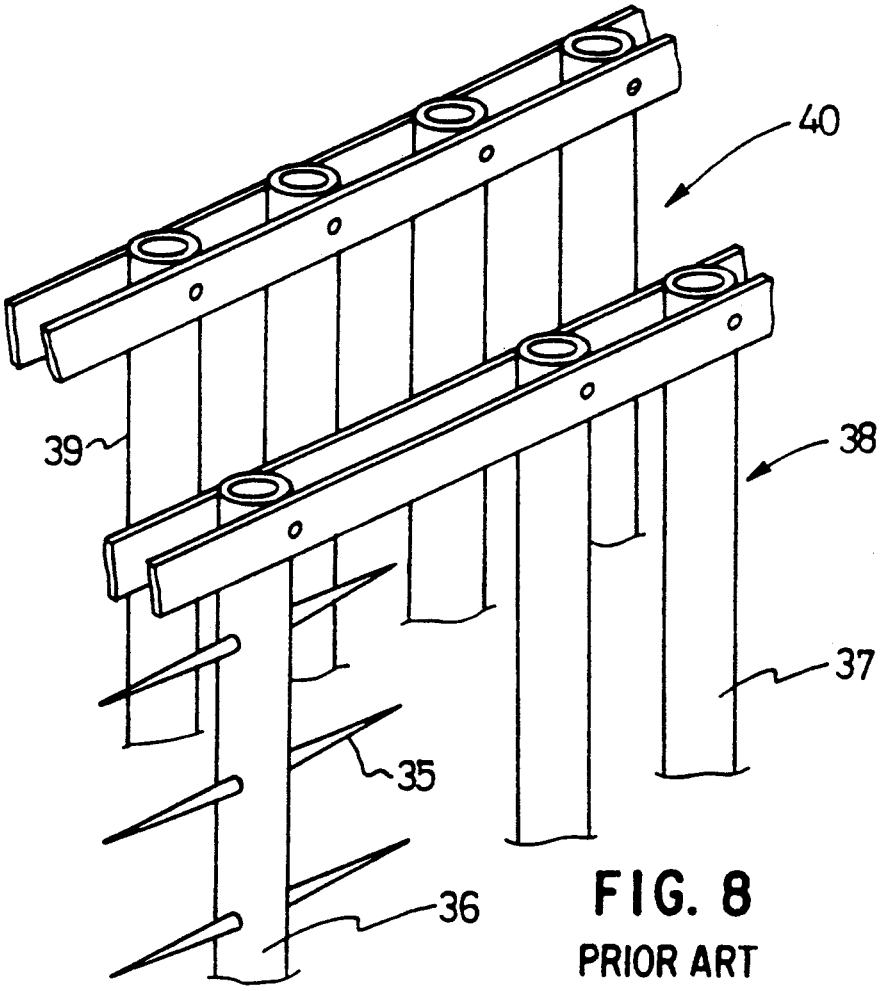
FIG. 8 PRIOR ART
FIG. 8 is a perspective view showing another example of a conventional electrostatic precipitator.

FIG. 6 shows an embodiment in which the electrostatic precipitator 1 of the present invention is installed in a row at four stages through a mounting flange 7 between the portion from the gas inlet duct 27 to the gas exhaust duct 28. In case the load quantity of dust and miscellaneous bacteria in the gas to be treated is large, it is also possible to improve the dust collecting efficiency by connecting the electrostatic precipitator 1 in a row as described above.

In the above-mentioned embodiments of the present invention, dry cleaning of a dust collecting electrode has been described, but it is a matter of course that it may be arranged so that a system of flowing water continuously to the dust collecting electrode (wet system) and a system of blowing jet water intermittently (intermittent cleaning) are combined respectively in place of the dry cleaning.

The present invention being constituted as above, the discharge electrode crosses with the passage of the gas to be treated. Therefore, it is possible to install the discharge electrode optionally for a unit area of effective sectional area of the gas to be treated passing through the electrostatic precipitator, and also to make an intense electric field uniform for the gas to be treated so as to produce a very efficient charged portion, thereby to improve the dust collecting efficiency remarkably. Further, since almost no reversely charged particle sticks to the discharge electrode, the dust collecting efficiency is not lowered and the hammering device for removing reversely charged particles which have stuck by giving an impact to the discharge electrode is not required. Thus, it is possible to reduce the cost. Further, due to the fact that the hammering device for cleaning the dust collecting section is provided outside the casing which is the passage of the gap to be treated, the hammering device is not deteriorated by dust, thus making maintenance simple. Moreover, since the discharge section and the dust collecting section which are principal parts of the electrostatic precipitator and the high voltage application unit and the dust collecting chamber are provided as one body in a frame, the production process is simplified in case the electrostatic precipitator of the present invention is installed in a row in accordance with the load of the gas to be treated.

What is claimed is:

1. An electrostatic precipitator, comprising:

a discharge section positioned in a casing for inducing gas containing unwanted matter to flow from a gas feeding duct to a gas exhaust duct, the discharge section arranged at an angle to a flow direction of the gas; and dust collecting sections, each having a gas permeable configuration and installed parallel to each other at a distance in front of and to the rear of the discharge section, wherein a high voltage application unit is provided in the discharge section and a dust collection chamber is provided at a lower part of the dust collecting sections; the discharge section, dust collecting sections, high voltage application unit and dust collecting chamber being mountable on a frame as a single body, such that a plurality of the electrostatic precipitators are freely installable in a serial row through a mounting flange provided on a peripheral surface of the frame.

2. The electrostatic precipitator of claim 1, further comprising a hammering device located outside the casing for cleaning the unwanted matter from the dust collecting sections and a hammering rod provided in each of the dust collecting section, an outer end of each hammering rod extending beyond the casing and hammered by the hammering device.

* * * * *